United States Patent [19]

Chamberlain

[11] Patent Number: 4,524,872

[45] Date of Patent: Jun. 25, 1985

[54] UNIVERSAL LOCKING DEVICE

[76] Inventor: Lewis W. Chamberlain, 79 Abbey Rd., East Hampton, Conn. 06424

[21] Appl. No.: 466,379

[22] Filed: Feb. 15, 1983

Related U.S. Application Data

[63] Continuation-in-part of Ser. No. 248,953, Mar. 30, 1981, abandoned.

[51] Int. Cl.[3] ..... E05B 73/00

[52] U.S. Cl. ..... 211/4; 70/61; 211/8; 248/552

[58] Field of Search ..... 211/4, 5, 7, 8; 70/57, 70/58, 229, 230, 61; 248/551, 552, 553

[56] References Cited

U.S. PATENT DOCUMENTS

| | | | |
|---|---|---|---|
| 1,184,878 | 5/1916 | Rosenstock | 248/553 X |
| 3,138,260 | 6/1964 | Tedrick | 211/5 X |
| 3,831,892 | 8/1974 | Herman | 211/4 X |
| 3,970,196 | 7/1976 | Legge | 211/5 |
| 4,008,587 | 2/1977 | Frentzel | 211/5 X |
| 4,248,399 | 2/1981 | Gipson | 211/4 X |

FOREIGN PATENT DOCUMENTS

| | | | |
|---|---|---|---|
| 1173603 | 12/1969 | United Kingdom | 248/552 |
| 2063344 | 6/1981 | United Kingdom | 248/552 |

*Primary Examiner*—J. Franklin Foss
*Assistant Examiner*—David L. Talbott

[57] ABSTRACT

An adjustable locking mechanism which supports and secures an object possessing a frame or like structure.

4 Claims, 9 Drawing Figures

22'
70
14'
68

22'
70
14'
68

76
74
70
72

66
22'
70
22'
14'
70
14'

UNIVERSAL LOCKING DEVICE

CROSS REFFERENCE TO RELATED APPLICATION

This application is a continuation-in-part of application Ser. No. 248,953 filed Mar. 30, 1981, now abandoned.

BACKGROUND OF THE INVENTION (1) Field of the Invention

The present invention relates to security and particularly to the prevention of unauthorized use of objects having an elongated frame member. Specifically, the present invention is directed to adjustable locking devices for suspending and securing objects which possess a frame or like structure. The present invention is particularly useful for the simultaneous suspended storage of and securing bicycles, ladders, small boats and the like against unauthorized removal. The general objects of the present invention are to provide novel and improved methods and appratus of such character.

(2) Description of the Prior Art

The use of locking mechanisms for preventing the unauthorized taking of property is well-known. A particular class of these known locking mechanisms are useful for locking objects which may be hung by a frame or like structure. This particular class of locking mechanism is typically mounted to a permanent structure, such as a wall or pillar. The object to be secured is usually supported within a clasp-like portion of the mechanism. This clasp-like portion is then closed by a lock which may either be integral with or separable from the locking mechanism.

The major disadvantage of the aforementioned type of prior locking mechanisms is that they are non-adjustable and can usually accommodate only the single type of object for which they were designed. Another disadvantage of these prior locking mechanisms resides in the fact that the locked objects cannot be conveniently stored at the same time they are being locked.

SUMMARY OF THE PRESENT INVENTION

The present invention overcomes the above-discussed disadvantages and other deficiencies of the prior art by providing an adjustable locking mechanism which can support an object which possesses a frame or similar elongated structural member.

A device in accordance with a first embodiment of the present invention comprises a supporting plate and a latching assembly. The latching assembly includes a bar having one end provided with a retaining means while the other end is generally U-shaped. This bar is slideably mounted within an aperture provided in the supporting plate. The frame or like structure of the object to be secured is located within the U-shaped end of the bar. The bar is then slid within the aperture so that the U-shaped end and the object are moved towards the plate. When the limit of inward movement is reached, and the object cannot be lifted out of the U-shaped support channel, the retaining means is used to lock the bar in place. In order to prevent unauthorized movement of the bar the retaining means is locked into position by a lock. Thus the locking mechanism of the present invention locks an object between the supporting plate and the U-shaped end of the bar. By providing a bar of sufficient length, objects of differing size may be locked within the mechanism of the present invention.

The supporting plate may be mounted to a permanent structure, such as a wall, ceiling or support beam. This allows both convenient storage and locking of an object.

In one embodiment of the present invention the supporting plate is provided with elongated slots which receive and permit lateral relative movement between parallel bars. By permitting lateral adjustment, objects having differing lengths, widths or configurations may be supported and secured by the present invention.

In accordance with another embodiment the bar itself performs the function of the plate and will also engage the permanent structure. To this end, the bar has a generally U-shaped extension at its free end, the open end of the "U" facing upwardly, and an apertured flat bar will bridge the U-shaped extension and loosely engage both legs thereof. A locking mechanism engages, by means of complimentary threads, one leg of the U-shaped portion and may be locked to the flat bar with a conventional lock.

BRIEF DESCRIPTION OF THE DRAWINGS

The present invention may be better understood and its numerous advantages and objects will become apparent to those skilled in the art by reference to the accompanying drawing wherein like references numerals refer to like elements in the several figures and in which.

DESCRIPTION OF THE DISCLOSED EMBODIMENTS

The present invention is directed to locking devices from which an object having a frame or like structure may be supported while being locked in place. In use the present invention is typically adjustable in two directions whereby it may be used to lock and support objects of differing sizes and shapes.

Figure 1:
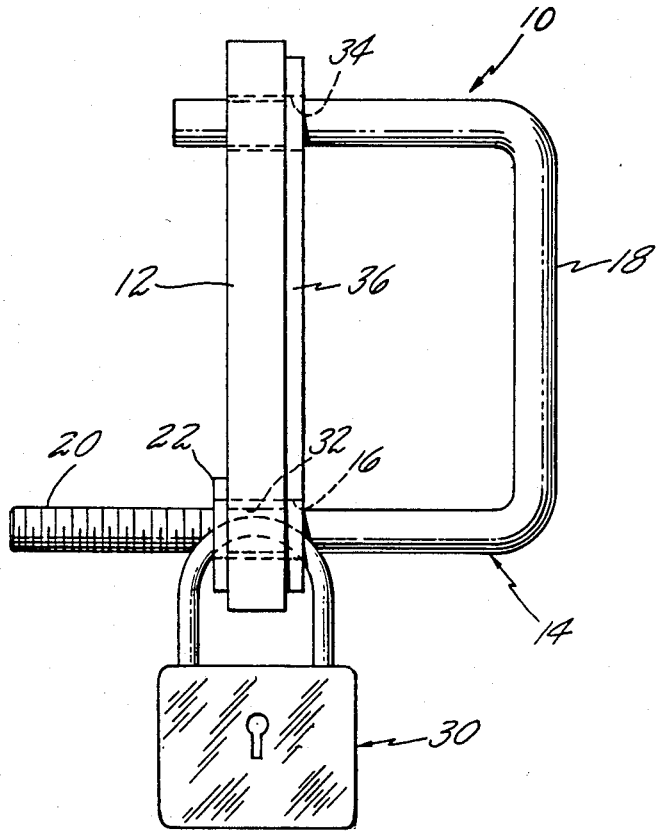
FIG. 1 is a side elevation view of apparatus in accordance with one embodiment of the present invention.
Figure 2:
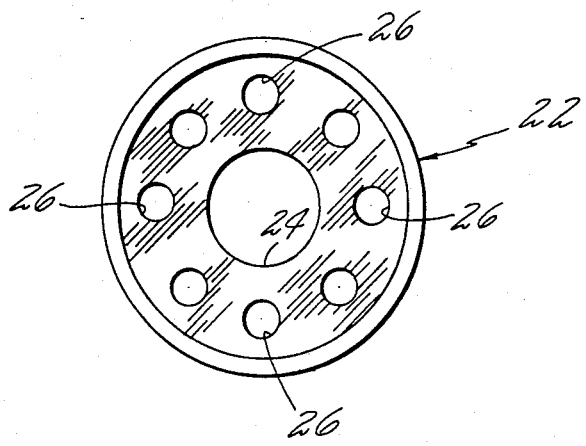
FIG. 2 is a front view of retaining means for use in the present invention.

A locking mechanism in accordance with a first embodiment of the present invention is indicated generally at 10 in FIG. 1. Mechanism 10 comprises a supporting plate 12 and at least a first locking bar 14. Bar 14 passes mounted through an aperture 16 provided in plate 12 and has, at one end, a generally U-shaped extension 18. The end of bar 14 which is not formed into the U-shaped extension 18 is provided with threads 20 which are engaged by a locking nut 22 which is depicted alone in FIG. 2.

Locking nut 22 is preferably round with its outer periphery being knurled, the knurled portion allowing nut 22 to be grasped. Nut 22 is provided with an axial aperture 24 which has an internal thread complimentary to the threads 20 on bar 14. This allows nut 22 to be mounted on bar 14. The locking nut 22 is further provided with a plurality of locking apertures 26 which are circularly arranged around aperture 24. These apertures 26 are spaced about the nut 22 so that they can be aligned with a single aperture 32, provided in plate 12, by rotating the nut 22. The function of apertures 26 will be discussed below.

With reference again to FIG. 1 the operation of mechanism 10 will now be discussed. An object possessing a frame or like structure is positioned within U-shaped extension 18. If the object is a bicycle, a portion of its frame is supported in extension 18. The bar 14 is then slid within aperture 16 so that both extension 18 and the object move towards the plate 12. When the end of the upper leg of U-shaped extension 18 also extends into an opening provided in the plate 12, as shown in FIG. 1, the nut 22 is moved on bar 14 until it contacts the rearwardly facing side of plate 12. This retains the bar 14 in position about the object.

In order to prevent the unauthorized removal of the object by backing off nut 22, an aperture 26 in nut 22 is aligned with the aperture 32 in plate 14 and the shackel 28 of a lock 30 is passed through aligned apertures 32 and 26. This prevents nut 22 from being rotated and, with the extension 18 grasping the object, the bar 14 also cannot be rotated. Thus the object is locked and secured to the locking mechanism 10.

In the disclosed embodiment plate 12 is provided with a slot 34 for receiving the free end of extension 18 of bar 14. This is especially advantageous when the object to be secured has small dimensions. By placing the tip of extension 18 into slot 34 the bar 14 is prevented from rotating. The slot 34 may be wider, in the vertical direction, than the diameter of bar 14 thereby permitting a limited degree of angular adjustment of extension 18 of the bar such as may be necessary when supporting and locking a girl's bicycle which does not have a horizontal frame member. Alternatively, plate 12 may have one or an array of circular apertures, slightly larger in diameter than the diameter of bar 14, through which the bar extension passes. Also, although not as secure an arrangement, the extension of bar 14 may merely be brought into contact with or adjacent to the face of plate 14 in the locked position. It is further preferable to secure a rubber, or like material, layer 36 to the surface of plate 12 which faces the object being locked within mechanism 10. This layer 36 of resilient material protects the object from being damaged or scratched when being locked.

Figure 3:
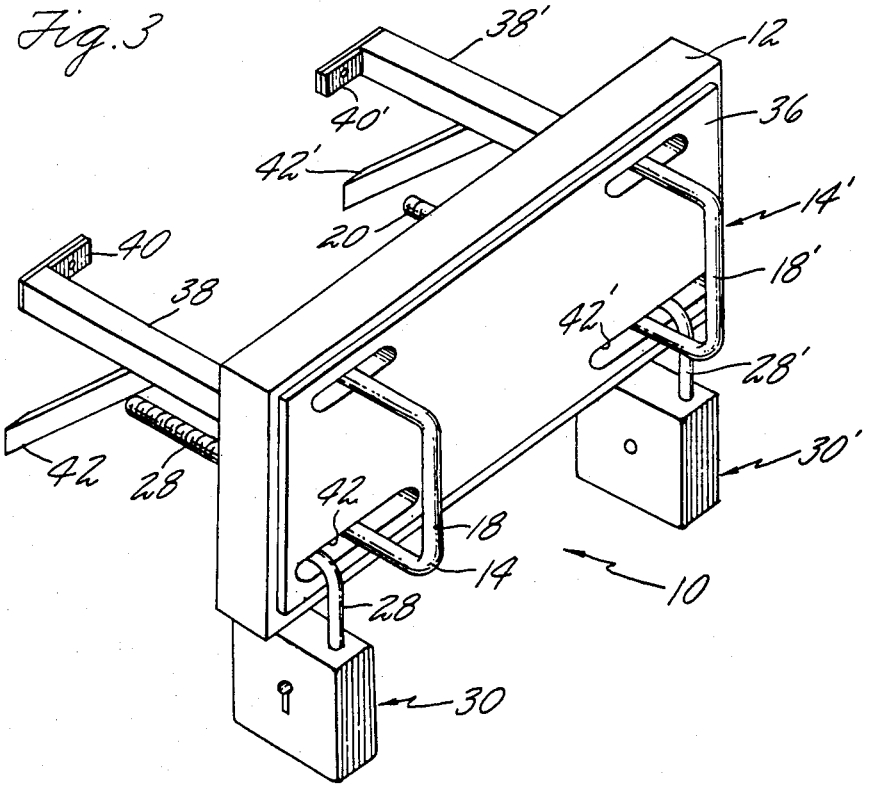
FIG. 3 is a perspective view of a second embodiment of the adjustable locking mechanism of the present invention.

While the mechanism 10 described in conjunction with FIG. 1 may be merely locked to an object it is preferable to secure it to a permanent structure, i.e., a wall, ceiling, etc. In order to facilitate the attachment of mechanism 10 to a permanent structure, a mounting means may be provided. Referring to FIG. 3 this mounting means comprises struts 38 and 38' which are bolted to a permanent structure using brackets 40 and 40'. The struts 38 can also be U-shaped whereby each strut will have a pair of legs which may be affixed to a wall. The mechanism 10 of the FIG. 3 embodiment differs from the mechanism 10 of FIG. 1 primarily in that two bars 14 and 14' are provided and apertures 32 and slot 34 have been joined to provide a slotted aperture 42 of increased length. Bar 14' is also positioned within a corresponding slotted aperture 42' and lateral adjustment of the relative positions of bars 14 and 14' is permitted.

Since the remaining elements are similar to those described above, they will be given the same reference numerals, duplicates being primed, and will not be discussed any further. By permitting the bars 14 and 14' to undergo lateral movement, they can be moved towards or away from each other allowing objects of differing size to be locked to mechanism 10.

Figure 4:
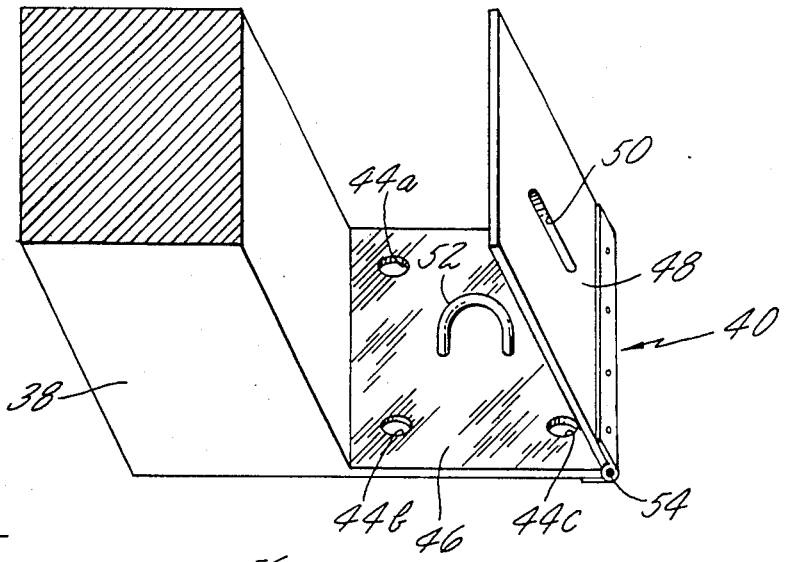
FIG. 4 is a perspective view, partly in section, of a brace for securing the apparatus of FIGS. 1 and 3 to a wall or like structure, FIG. 4 showing the means for locking the brace to a wall.

Referring again to the mounting means which includes struts 38 and 38', it may also be necessary for some applications to incorporate braces 42 and 42' to provide structural support. By securing the mechanism 10 to a wall or ceiling an object can be stored in a convenient manner, while also being locked. While any method of bolting brackets 40 and 40' to the wall, ceiling, etc., is satisfactory, it is preferable to do so in a manner to prevent unauthorized removal. In FIG. 4 one of the brackets 40 is shown in its preferred embodiment.

Bracket 40 is provided with four holes 44*a–d* in plate 46, through which bolts, screws etc. are passed to secure the bracket 40 to a wall, ceiling, etc. In order to prevent the unauthorized removal of the bolts or screws a cover 48 having a slot 50 is moveably attached to plate 46. Plate 46 has a clasp 52 that passes through slot 50 the preferred method of attachment being a hinge 54. By placing cover 48 over plate 46 the screws or bolts are covered and protected from removal. The cover 48 is retained over plate 46 by placing the shackel of a lock through clasp 52.

Figure 5:
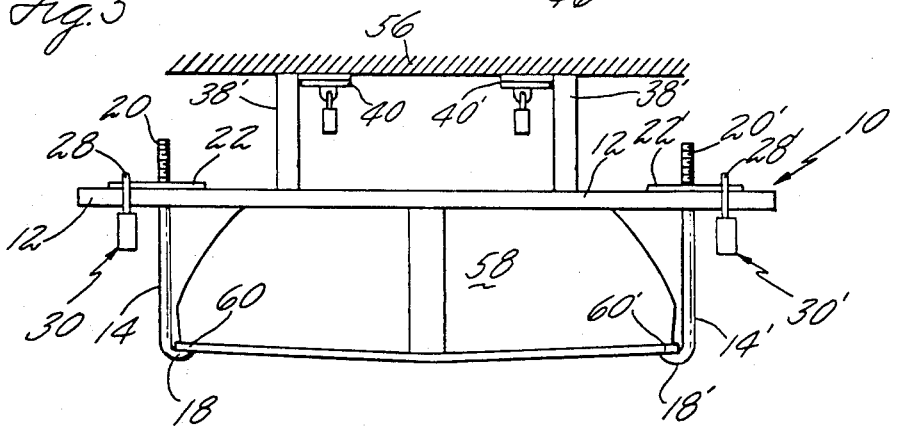
FIG. 5 is a front view of the apparatus of FIG. 3 with a small boat being locked thereto and supported therefrom.

Referring now to FIG. 5 the mechanism 10 is shown mounted to a ceiling 56 and having a boat 58 locked to and supported therefrom. The gunwales 60 and 60' of boat 58 are engaged by extensions 18 and 18', respectively. The bars 14 and 14' are slid up ythrough plate 12 and locking nuts 22 and 22' are fastened down upon their respective bolts. The mechanism 10 is then locked by passing the shackels 28 and 28' of locks 30 and 30', respectively, through apertures 26 and 26' and apertures 32 and 32' (slots 42, 42' of the embodiment in FIG. 3).

Figures 6, 7, 8, 9:
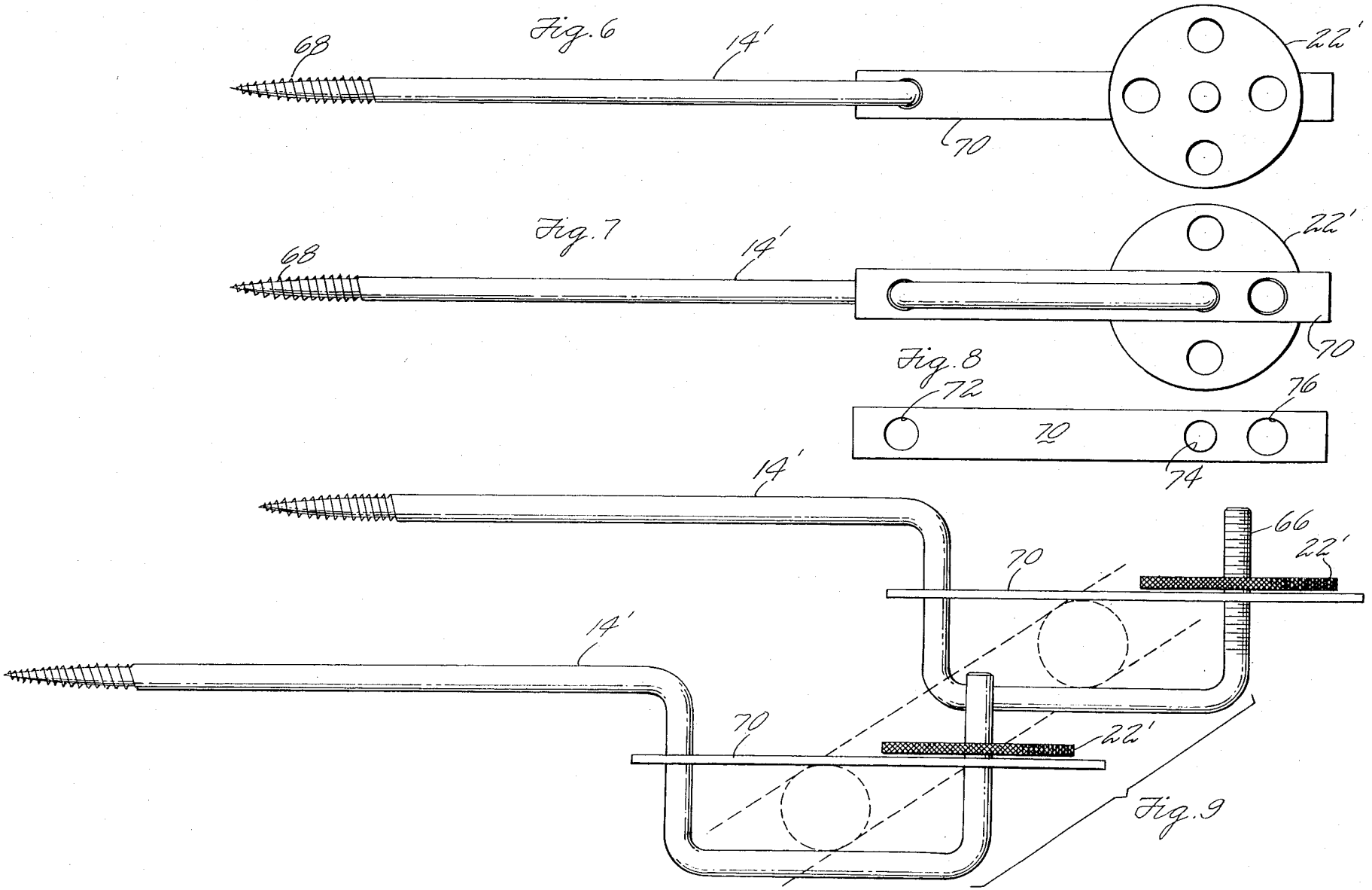
FIG. 6 is a top view of a locking device in accordance with a third embodiment of the invention.
FIG. 7 is a side-elevation view of the apparatus of FIG. 6.
FIG. 8 is a top view of the locking bar of the apparatus of FIG. 6.
FIG. 9 is a perspective view depicting use of the embodiment of FIGS. 6–8.

In the embodiment of FIGS. 6–8 the plate 12 of the above-described embodiments has been eliminated and the U-shaped extension 18 of bar 14' has been rotated 90° in the clockwise direction. thus, as the locking device is shown in FIG. 7, the open end of the U-shaped extension faces upwardly. A screw thread 66 extends inwardly from the end of the outermost leg of the U-shaped extension as shown. The oppositely disposed end of bar 14' is provided with a wood screw 68 thread whereby the device may be affixed to a building structural member. Other mounting arrangements are, of course, possible.

The device of FIGS. 6–8 further comprises a flat bar 70 provided with three (3) apertures 72, 74 and 76. Apertures 72 and 74, which may be slightly elongated, are spaced apart so as to enable the installation of bar 70 on the legs of the U-shaped extension of bar 14' as shown. A lock nut 22', similar to the lock nut of FIG. 2, will engage the threaded end 66 of the U-shaped extension. In the manner described above, engagement of a lock with aligned apertures in the lock nut 22' and aperture 76 in bar 70 will prevent unscrewing of the lock nut and thus removal of the bar.

The locking devics of FIGS. 6–8 are typically employed in pairs as shown in FIG. 9. With an object, for example the frame of a bicycle or the leg of a ladder, secured to a cooperating pair of the locking devices, rotation of the individual locking devices in an effort to detach them from the building structure will be prevented.

While preferred embodiments have been shown and illustrated, various modifications and substitutions may be made thereto without departing from the spirit and scope of the present invention. By way of example, rather than securing plate 12 to the supporting structure, the rod 14 may be fixed in position and the plate moveable on the rod relative to extension 18. Accordingly, it is to be understood that the present invention has been described by way of illustration and not limitation.

What is claimed is:

1. A combination support and securing device comprising:

elongated bar means, said bar means having a first linear portion which defines an axis and a second generally U-shaped portion extending from a first end of said linear portion, said U-shaped portion having a pair of spacially displaced legs with axes which are substantially perpendicular to said axis, a generally U-shaped object receiving channel being defined between said legs, a first end of a first of said legs being integral with the said first end of said linear portion, the second of said legs being provided with a threaded section extending from the free end thereof;

a flat plate, said plate being provided with a plurality of apertures, a pair of said apertures being spacially displaced and sized whereby said plate will loosely engage both of said legs of said U-shaped portion of said bar means, said plate having at least a third aperture located between an edge thereof and one of said apertures of said pair, said plate being movable along said legs of said bar means U-shaped portion to define an adjustable retaining member which bridges said object receiving channel; and lock nut means, said lock nut means being provided with a central aperture, said central aperture having a thread which is complementary to the thread on said section of said bar means U-shaped portion second leg whereby said lock nut means may be installed on said bar means, said lock nut means further being provided with at least a first aperture positioned between said central aperture and the periphery of said lock nut means, said second aperture being alignable with said third aperture of said plate whereby the shackle of a lock may be passed through said aligned apertures; and means for affixing said bar means to a support structure.

2. The apparatus of claim 1 wherein said lock nut means includes a plurality of apertures located between said central aperture and the periphery thereof so as to be individually alignable with said third aperture in said plate.

3. The apparatus of claim 2 wherein said affixing means comprises:

a wood screw thread on the second end of said bar means linear portion.

4. The apparatus of claim 1 wherein said affixing means comprises:

a wood screw thread on the second end of said bar means linear portion.

* * * * *